US005180045A

United States Patent [19]

Sonnendorfer et al.

[11] Patent Number: 5,180,045

[45] Date of Patent: Jan. 19, 1993

[54] SECURING DEVICE FOR CARTS

[75] Inventors: Horst Sonnendorfer; Franz Wieth, both of Eichenau, Fed. Rep. of Germany

[73] Assignee: SYSTEC Ausbausysteme GmbH, Eichenau, Fed. Rep. of Germany

[21] Appl. No.: 612,683

[22] Filed: Nov. 15, 1990

[30] Foreign Application Priority Data

Jul. 23, 1990 [DE] Fed. Rep. of Germany ..... 4023396

[51] Int. Cl.[5] ..... G07F 5/02

[52] U.S. Cl. ..... 194/212; 194/905

[58] Field of Search ..... 194/205, 212, 250, 252, 194/247, 905

[56] References Cited

U.S. PATENT DOCUMENTS

| | | | |
|---|---|---|---|
| 4,474,280 | 10/1984 | Lenandes | 194/905 X |
| 4,618,050 | 10/1986 | Payraudeau | 194/905 X |
| 4,637,507 | 1/1987 | Ricouard et al. | 194/212 |
| 4,924,994 | 5/1990 | Pinsson et al. | 194/905 X |
| 5,069,324 | 12/1991 | Lapage et al. | 194/212 |

FOREIGN PATENT DOCUMENTS

| | | | |
|---|---|---|---|
| 0258624 | 3/1988 | European Pat. Off. | 194/212 |
| 3324962 | 4/1983 | Fed. Rep. of Germany . | |
| 3436610 | 9/1984 | Fed. Rep. of Germany . | |
| 3508772 | 10/1986 | Fed. Rep. of Germany . | |
| 84/04835 | 12/1984 | World Int. Prop. O. | 194/905 |
| 86/04174 | 7/1986 | World Int. Prop. O. . | |
| 88/01084 | 2/1988 | World Int. Prop. O. . | |
| 90/07167 | 6/1990 | World Int. Prop. O. . | |

*Primary Examiner*—Michael S. Huppert
*Assistant Examiner*—William M. Hienz
*Attorney, Agent, or Firm*—Browdy and Neimark

[57] ABSTRACT

A securing device (1) for carts having a chain (82) with a first end secured to a screw (7) mounted on a cart, a first key secured to a second end of the chain (82), a coin receptor for releasing and retaining an introduced coin (50, 51), and additional apparatus for coupling and uncoupling the cart to and from another parked cart. When a second key (8') secured to the other parked cart is introduced into the securing device (1) to couple and securely hold the cart to the other parked cart, a coin (50, 51) from the coin receptor of the cart is released and the cart can be uncoupled from the other parked cart by introducing a next coin (50, 51) into the coin receptor thereby releasing the second key (8') while the next coin (50, 51) is retained in the coin receptor. The apparatus for coupling and uncoupling includes a pivotable locking part (2) for lockingly engaging the second key (8'), a spring returned part (3) biased toward the coin receptor for maintaining the locking part (2) in engagement with the second key (8') and releasing the next coin. Introduction of the second key (8') pivotably urges the locking part (2) into locking engagement with the second key (8') and permits the part (3) to return toward the coin receptor, releasing the next coin and engaging the locking part (2) to maintain the locking part (2) in locking engagement with the second key (8').

6 Claims, 2 Drawing Sheets

SECURING DEVICE FOR CARTS

BACKGROUND OF THE INVENTION

1. Field of the Invention

The invention relates to a securing device for carts, in particular for shopping carts.

The term "carts" is understood hereinafter to include all hand-propelled vehicles which have a pusher, generally in the form of a tubular push handle, and can be inserted into one another in a known manner, such as shopping carts used in supermarkets, baggage carts that are made available to travelers in train stations or airports, and the like. Often, a large number of carts are coupled together; the first cart is generally properly parked at a stationary central point, and all the following carts are connected to the last properly parked, coupled cart in succession.

At pickup points, such as in the entry area of self-service stores, airports or train stations, a token must be introduced into the securing device of the most recently coupled cart in order to uncouple it; the token is not returned until the cart, no longer needed, is properly coupled at an intended central point, preferably to a cart already coupled there.

2. The Prior Art

One such securing device for carts, in particular shopping carts, is described in European Patent Application 286 460, for example. In this securing device, a lock of a coin-operated vending apparatus has two identically embodied levers, which are disposed symmetrically to an imaginary center line of the securing device and are each pivotable about an axis. The two end regions of the two levers are embodied such that one set of ends performs a coin testing function, and once a coin has been introduced performs a coin holding function, while the opposite ends of the two levers are hook-like, so that they fit into suitably embodied notches in the blank of a key introduced into the lock. When, at a central point or at a properly coupled cart, a key is introduced into the securing device of the cart to be parked, the introduced key is held in the locked position by the two cooperating, identically embodied levers; at the same time, the coin introduced when the cart is picked up is released.

In practice tensile strains are exerted upon the securing devices of individual carts via the keys introduced and the chains, to the free ends of which a key is attached. If a correspondingly high tensile strain is now exerted upon the securing device of a properly parked cart by the cart preceding it or by other carts, this tensile strain is transmitted via the key to the two pivotable levers of the securing devices of the cart being uncoupled.

When a cart is to be uncoupled, a considerable tensile strain is being exerted, upon the securing device including the two levers. To relieve this strain a contrary force must be brought to bear via the coin to be introduced such that the two levers of this securing device release the retained key to a sufficient extent that the key is no longer firmly retained. Then cart, can be properly removed from the securing device in which the coin has been introduced. Often, however, the tensile strain exerted upon the two levers of such a securing device is so strong that the levers cannot be released by pressing the coin inward. Instead, the tensile strain with respect to the next cart or carts in succession can often be reduced only by forcefully pushing the carts together, at least to such an extent that the coin is introduced into the securing device of the last cart, unlocking the key, and thus permitting the last cart in line to be uncoupled. Proceeding in this way is often very strenuous and tedious especially for women.

BRIEF SUMMARY OF THE INVENTION

It is therefore the object of the invention to create a securing device for carts in which it is assured that the function of the securing device cannot be affected at all by any forces, in particular tensile forces, so that its function is reliably and securely maintained. In the securing device according to the invention, a separate locking element is provided, which is pivotably retained in the housing of the securing device in such a way that on the one hand a key is reliably held and securely locked. However, when on the other hand a tensile strain, is exerted by the next cart, via the chain on it and the key attached to it, upon the securing device of the cart to be taken, the strain acts solely upon the locking element and not on the other functional elements of the securing device. Accordingly, regardless of a strong tensile strain exerted upon a retained key by the next cart or carts, the introduction of a coin and the uncoupling of the last cart parked in a line is not affected. Thus, only a constant, slight resistance must ever be overcome when introducing a coin to uncouple the last cart.

To enable using the securing device according to the invention in border regions, for example, so that a cart can be released with coins of different dimensions but approximately the same value, an interchangeable coin insert preferably with two slots is provided; thus a cart can be released with the particular coin available, for example a Deutsche Mark or a Swiss Franc, a Deutsche Mark or a Dutch Guilder, a Deutsche Mark or a 5-Schilling piece, and so forth. With this provision, the versatility of the securing device according to the invention is very considerably increased and improved.

The invention will be described below in terms of a preferred embodiment, referring to the accompanying drawings.

DETAILED DESCRIPTION OF THE PREFERRED EMBODIMENT

Figure 1:
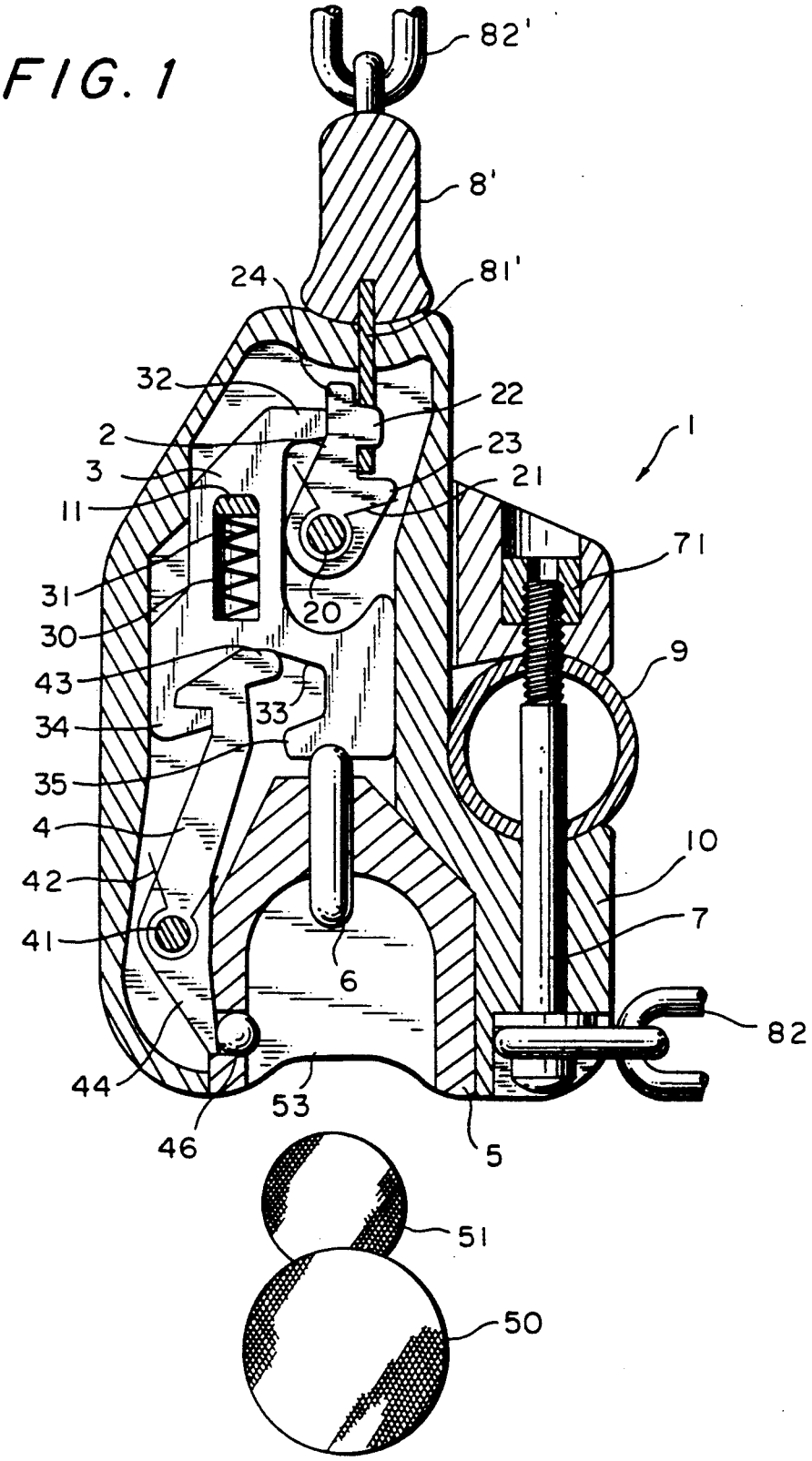
FIG. 1, is a sectional view of a securing device in which a key is securely held and locked.
Figure 2:
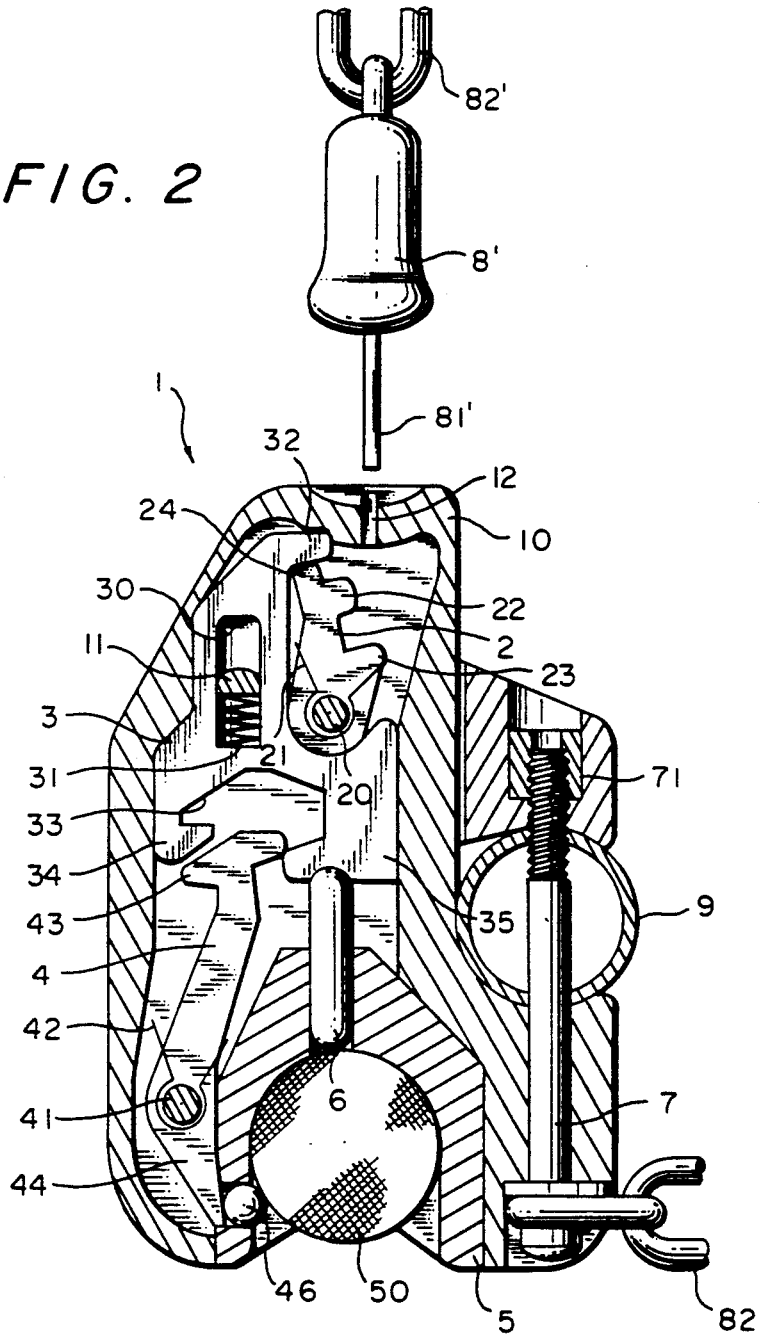
FIG. 2, again is a sectional view corresponding to FIG. 1, of a securing device in which the secured, locked key of FIG. 1 is released.

FIGS. 1 and 2 are each sectional views of a preferred embodiment of a securing device 1. A housing 10 of the securing device 1 is retained by means of a fastening screw 7 and securing nut 71 on a tubular pusher handle 9, also shown in section, for instance of a shopping cart. The fastening screw 7 simultaneously also holds the last link of a chain 82, shown only schematically, on the securing device 1; the key of the securing device 1, which is secured to the other end of the multiple-link chain 82, is not shown.

A key 8' is shown in the upper portion of FIGS. 1 and 2. Key 8' is attached to the corresponding end of a chain 82', secured for instance to a properly parked cart, not shown in further detail. In order to clearly show that the chain 82' and the key 8' are elements of a different securing device, their reference numerals are provided with an apostrophe ('). The securing device 1 secured to the tubular handle 9 of a shopping cart, not shown, is equipped in such a way that it (the securing device 1), or an imaginary line in the extension of the key 8', extends approximately horizontally.

In the securing device I, a coin insert 5, shown shaded, is provided on the side opposite a key insertion slit 12; a coin testing ball 46 and a displaceable scanner pin 6 are provided in the insertion slit 53 of the coin insert. The coin testing ball 46 rests on a front end 44 of a coin testing lever 4 that is pivotable about a shaft 41 by the action of a restoring spring 42; the rear end 43 of this lever, which protrudes into the interior of the housing 10 of the securing device, is embodied in the form of a hook. The rear hooked end 43 of the coin testing lever 4 is disposed in or in the vicinity of a recess 33 of a displaceable part 3, depending on the particular position of the elements of the securing device 1. The other end of the scanner pin 6 that protrudes into the coin insert rests on an attachment 35 of the displaceable part 3 adjacent to the recess 33.

In the view of FIGS. 1 and 2, a cut-out 30 is provided above the recess 33 in the displaceable part 3, and an attachment 11 of the housing 10 protrudes into this cut-out and a compression spring 31, which is stretched between the attachment 11 and the opposite end of the cut-out 30 is disposed in the cut-out. The displaceable part 3 has a locking protrusion 32 on an end remote from the recess 33.

A locking part 2, which is pivotable about a shaft 20 retained in the housing 10, is also provided in the upper part of the housing 10 of the securing device 1 as shown in FIGS. 1 and 2. A restoring spring 20 retained on the shaft 20 seeks to pivot the locking part 2 counterclockwise, as will be described in further detail hereinafter.

The locking part 2 has a hooked protrusion 22, which in FIG. 1 protrudes into a cut-out, not identified by reference numeral, of a key blank 81' of the key 8'. Also shown in FIG. 1 are two coins 50 and 51 of different dimensions, shown partly shaded.

As already noted above, in the sectional view of FIG. 1 a key 8' or its key blank 81' is securely held by the locking part 2, or its hooked protrusion 22, in the securing device 1 and locked in secured fashion by the locking protrusion 32 of the displaceable part 3. If the shopping cart, on the tubular handle 9 of which, shown in section, the securing device 1 is secured is to be uncoupled, the coin 50 must in this case be introduced into the coin insertion slit 53 of the coin insert 5.

When the coin 50 is inserted, the diameter of the coin inserted is monitored by the coin testing ball 46, on the one hand, and on the other hand the front end 44 of the coin testing lever 4 is pivoted clockwise somewhat, causing its rear end 43 to be released from a retaining protrusion 34 of the displaceable part 3 and pivoted some distance toward the right. Upon continued introduction of the coin 50, the scanner pin 6 is pushed into the interior of the housing 10; as a result, the displaceable part 3, now no longer secured by the coin testing lever 4, is displaced counter to the action of the compression spring 31 toward the key 8', which is held in the housing 10. Upon the displacement of the part 2, its locking protrusion 32 slides along the rear side of the locking part 2 (upward in the view of FIG. 1).

As soon as the displaceable part 3 has been displaced by the scanner pin 6 far enough (upward, in FIG. 1), because of the continued introduction of the coin 50, so that the end of the locking part 2 is released by the locking protrusion 32, the locking part 2 is pivoted counterclockwise by the restoring spring 21 into the position shown in FIG. 2.

The hooked protrusions 22 of the locking part 2 now no longer engages the cut-out in the blank 81' of the key 8'; instead the key 8' is pivoted upward somewhat, in the view of FIG. 2, by the locking part 2 and as a result is released by the securing device 1. By means of the locking part 2, which has been pivoted counterclockwise, the displaceable part 3 is held in the position shown in FIG. 2, in this position the compression spring 31, pressed against the attachment 11, no longer exerts any force by means of the part 3 upon the scanner pin 6.

As a result of the displacement of the part 3, the hooked end 43 of the coin testing lever 4 is essentially no longer located in the recess 33 of the displaceable part 3 and as a result assumes the position shown in FIG. 2, which with respect to the coin testing lever 4 is identical to the position shown in FIG. 1 prior to the introduction of the coin 50. The coin testing ball 46 is again in the position shown in FIG. 2, and as a result the introduced coin 50 is retained in the coin insertion slit. The free end of the coin insertion slit 53 is dimensioned such that the inserted coin 50 does not protrude to the outside beyond the coin insertion slit 53 and thus cannot be removed improperly.

Once the properly uncoupled shopping cart is no longer needed and has been returned to a central point, then all that is needed in order to have the previously introduced coin 50 returned is for a key 8', secured to a chain 82' at the central point or on a cart properly coupled there, to be introduced into the insertion slit 12. The front end of the blank 81' of the introduced key 8' then strikes an attachment 23 of the locking part 2, which as a result is pivoted clockwise. As soon as the locking protrusion 32 of the displaceable part 3 is free of the upper end 24 of the locking part 2, as shown in FIG. 2, the displaceable part 3 is spring biased downward in the direction of the coin insert 5, as shown in FIG. 1, by the compression spring 31. As a result, the scanner pin 6 is also displaced downward as shown in FIG. 1, so that once again the coin 50 has been pushed far enough out of the slit 53 of the coin insert 5 that it can be withdrawn from the coin slit 53 without difficulty.

When the coin 50 is ejected, the front end 44 of the coin testing lever 4 is pivoted some distance clockwise, counter to the force of the restoring spring 42, by the coin testing ball 46. Because of the embodiment of the recess 33 in the part 3, the hooked end 43 of the coin testing lever 4 again rests on the retaining protrusion 34 of the displaceable part 3, as can be seen in FIG. 1. Whenever the displaceable part 3 is in the position shown in FIG. 1, the hooked protrusion 22 of the locking part 2 again engages the cut-out, not identified by reference numeral, in the blank 81' of the introduced key 8'. By means of the locking protrusion 32, which rests on the back of the locking part 2 opposite the hooked protrusion 22, the locking part is again securely locked in the position shown in FIG. 1.

Any tensile strain that is exerted, for whatever reason, by adjacent carts on the securing device 1 via the key 8' secured to the chain 82' is thus, in the securing device according to the invention, absorbed and intercepted solely by the locking part 2 which is pivotably retained in the housing 10 of the securing device I. As a result, no tension or compression whatever is exerted upon the other elements of the securing device 1, namely and in particular the displaceable part 3 and the coin testing lever 4, so that these parts are not exposed to any strain whatever, and thus their functional capacity is entirely unaffected.

Figure 3:
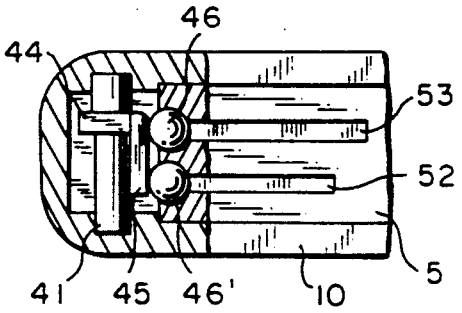
FIG. 3, is, partly in section, a front view of a coin insert provided in the securing device.

In FIG. 3, a partly cutaway front view of a coin insert 5 is shown. Two differently sized coin introduction slits 52 and 53 are provided in the coin insert 5, each associated with coin testing balls 46' and 46, respectively. Attached to the front end 44 of the coin testing lever 4 is a part 45, which extends perpendicularly to the two coin insertion slits 52 and 53. As a result of this modification of the coin insert 5, it is attained that the available coin 51 or 50 can be inserted into either the slit 52 or the slit 53 in order to release or uncouple a shopping cart.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A securing device (11) for carts having:

a chain (82) with a first end secured to a screw (7) mounted on a cart, a first key secured to a second end of said chain (82), coin receiving means for releasing and retaining an introduced coin (50, 51), means engaged to said coin receiving means for coupling and uncoupling said cart to and from another parked cart, wherein a second key (8') secured to said other parked cart is introduced into said securing device (1) to couple and securely hold said cart to said other parked cart, wherein introducing said second key (8') further releases a coin (50, 51) retained in said coin receiving means of said cart and wherein said cart can be uncoupled from said other parked cart by introducing a next coin (50, 51) into said coin receiving means thereby releasing said second key (8') while said next coin (50, 51) is retained in said coin receiving means, said means engaged to said coin receiving means for coupling and uncoupling comprising:

a pivotable locking part (2) for lockingly engaging said second key (8'), a spring returned part (3) biased toward said coin receiving means for maintaining said locking part (2) in engagement with said second key (8') and releasing said next coin, wherein introduction of said second key (8') causes said second key to engage and pivotably urge said locking part (2) into locking engagement with said second key (8') and permits said spring returned part (3) to move toward said coin receiving means, releasing said next coin and engaging said locking part (2) to maintain said locking part (2) in locking engagement with said second key (8').

2. The securing device in accordance with claim 1, wherein said spring returned part (3) is held in a fixed position by a coin tester (4) when said spring returned part (3) is engaged to said locking part (2) and said locking part (2) is in locking engagement with said second key (8').

3. The securing device in accordance with claim 1, wherein said locking part (2) has a hook which corresponds to an opening in said second key (8'), said hook being engaged in said opening when said locking (2) is in locking engagement with said second key (8').

4. The securing device in accordance with claim 2, further comprising a transversely extending part (45) provided at one end of the said coin tester (4), said transversely extending part (45) being perpendicular to two dissimilarly dimensioned coin introduction slits disposed side by side.

5. The securing device in accordance with claim 4, wherein said two introduction slits are disposed on said coin receiving means.

6. The securing device in accordance with claim 1, wherein said pivotable locking part (2) is engaged to a spring which biases said locking part (2) away from a slot in said securing device (1) before introduction of said second key (8').

* * * * *